United States Patent [19]

Romano et al.

[11] 4,142,722

[45] Mar. 6, 1979

[54] SEAT MOUNTED SIMULATED WEAPON AND TARGET SHOOTING GAME

[75] Inventors: John V. Romano; Roger D. Hector, both of San Jose, Calif.

[73] Assignee: Atari, Inc., Sunnyvale, Calif.

[21] Appl. No.: 873,143

[22] Filed: Jan. 30, 1978

[51] Int. Cl.[2] ..... A63F 9/02; F41F 27/00; F41J 9/00

[52] U.S. Cl. ..... 273/101.1; 273/105.2

[58] Field of Search ..... 35/25; 273/101, 101.1, 273/101.2, 105.1, 105.2, 127 R; 272/1 C, 1; 297/181

[56] References Cited

U.S. PATENT DOCUMENTS

| | | | |
|---|---|---|---|
| 2,562,648 | 7/1951 | Sparrow | 273/101.1 |
| 2,661,954 | 12/1953 | Koci | 273/105.2 X |
| 3,294,401 | 12/1966 | Nicholas et al. | 273/101.1 |
| 3,452,453 | 7/1969 | Ohlund | 273/101.1 X |
| 3,866,917 | 2/1975 | Ensmann et al. | 273/127 R X |
| 4,039,188 | 8/1977 | Goldfarb et al. | 273/127 D X |
| 4,063,368 | 12/1977 | McFarland et al. | 273/101.1 X |

*Primary Examiner*—Vance Y. Hum

*Attorney, Agent, or Firm*—Townsend and Townsend

[57] ABSTRACT

A shooting game includes opposed stations which include a pair, target and gun which are movable as a unit by the player sitting on the chair. A simulated landscape interposed between the players includes a score display. When either player actuates his gun this produces a light flash which is sensed by the photodector type target on the other player's station. A highly animated seat makes a difficult target to hit.

6 Claims, 2 Drawing Figures

SEAT MOUNTED SIMULATED WEAPON AND TARGET SHOOTING GAME

BACKGROUND OF THE INVENTION

The present invention is directed to a shooting game and more specifically to one where a pair of players actuate rifles producing a light flash which is sensed by associated photodetector type targets.

Shooting arcades are quite old where one or more players shoot at several mechanically actuated targets which are moved in predetermined motions to make the target difficult to hit. One such game is shown in a copending application Ser. No. 813,807 filed July 8, 1977 in the name of Rains et al, entitled "Shooting Arcade Game" and assigned to the present assignee. Such game has suitable electronic circuitry usable in the present game as will be discussed below.

One disadvantage of the above target arcade games is that the opponent is, of course, a mechanically or automatically actuated targets which may not offer sufficient challenge. One prior art type of game which does utilize a human target is fencing and especially with electrically actuated foils where a touch by one party against the chest of the other produces a scoring point. Fencing, of course, requires extra equipment in order to avoid its dangerous side effects.

OBJECTS AND SUMMARY OF THE INVENTION

It is, therefore, an object of the present invention to provide an improved shooting game.

In accordance with the above object there is provided a shooting game for at least two players comprising a gun and associated target for carrying by each player. Hit indicating means associated with each target are provided for visually indicating a hit by another player.

DETAILED DESCRIPTION OF THE PREFERRED EMBODIMENT

Figure 1:
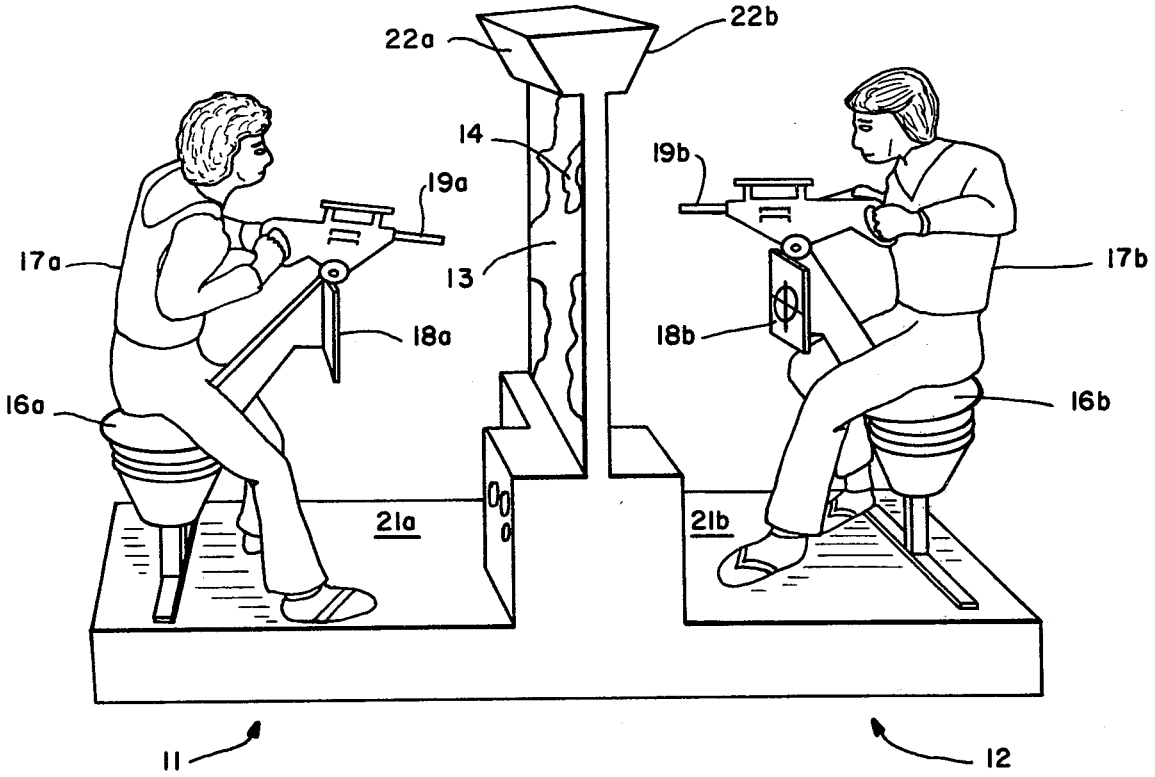
FIG. 1 is a perspective view of a shooting game embodying the present invention.

Referring to FIG. 1, the shooting game includes two opposed stations 11 and 12 which have interposed between them a simulated landscape 13 having obstacles such as trees and land masses 14 which block the target of one station from the gun of another station. Each station 11 and 12 includes a tiltable or swivel seat 16*a,b* for seating a player 17*a,b*, a photodetector target 18*a,b* and a gun which produces a light flash sensed by the photodetector target 19*a,b*. The seat, target and gun 16, 18 and 19 form a unitary rigid structure which may be tilted or swivelled by the respective players. In other words, the seats 16*a, b* are mounted on their respective platforms 21*a,b* of stations 11 and 12 respectively to provide for a full range of movement. For example, there would be a simple spring and swivel mounting.

Simulated landscape 13 also includes a score display unit 22 and has individual score displays for each player. Such score display includes a numerical score along with any desired color or sound effects.

In operation, each player sits in an opposing chair which is, of course, equipped with its associated "ray" gun and target. When an appropriate coin is placed in the game, the swivel chairs would be unlocked and play begins. One player tries to hit his opponent's target by firing his gun. At the same time his opponent is moving his chair trying to hit the target associated with the other player. In addition to the movement of one player trying to avoid the other's gun, the simulated terrain with its obstacles 14 prevents one player from firing at another. However, since the gun and target assembly 18, 19 are movable as a rigid unit one player cannot hide behind a terrain feature and still shoot at the opposing player.

When a hit is made, the score display is actuated or an explosion is heard or the platform 21*a,b* under the hit chair may glow red. The game, for example, can continue for 90 seconds after which bonus time play occurs after a given number of combined hits are scored. Alternatively, the game can continue for 20 shots per player and bonus shots can be awarded to the highest scoring player after a combined number of hits have been made.

Figure 2:
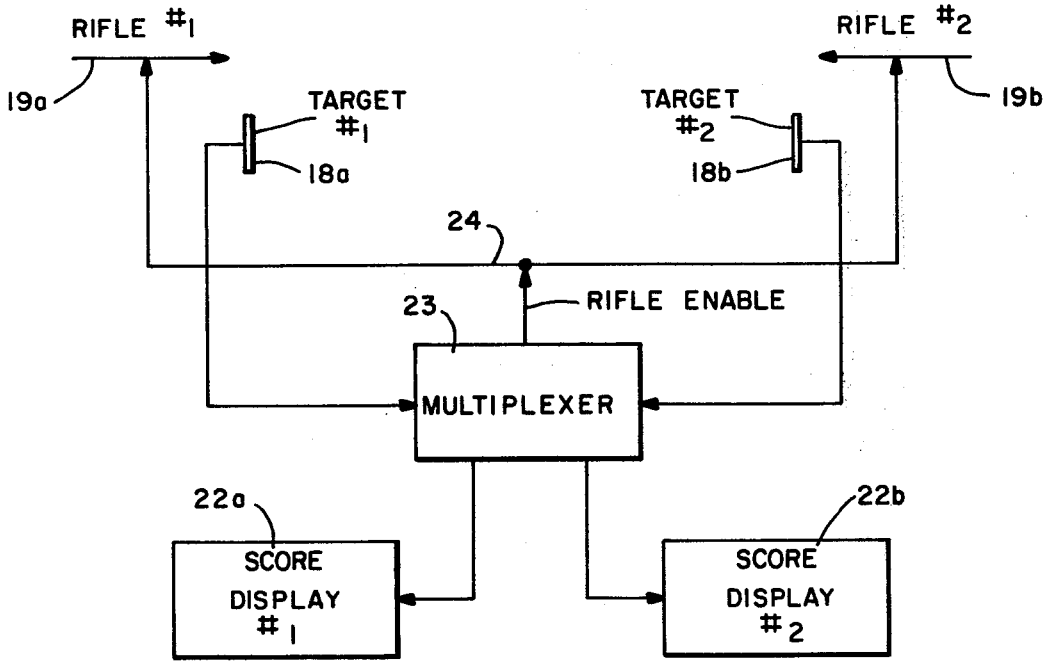
FIG. 2 is a block diagram of the associated electrical circuitry for the present game.

FIG. 2 illustrates the electrical circuitry associated with the above game which is very similar to that shown in the above copending Rains application. The photodetector type targets 18*a,b* are connected to a multiplexer 23 which provides a unique and dedicated time period during which each opposing rifle 19*a,b* is enabled via line 24. At the same time, the unique and dedicated time period allows the respective score displays 22*a,b* to be actuated. Such time sharing system would not absolutely be necessary in the case of a simple two person player game as illustrated here. However it does illustrate one mode in which the present invention can be implemented and has the advantage of preventing simultaneous hits where especially a sound scoring indication might be misleading.

The concept of the present invention has much broader application from that shown in the preferred embodiment of FIG. 1. For example, two players could have battery actuated guns with a photodetector target strapped to their chest and be free to use any naturally occuring obstacles. Hit indicating means associated with the target could merely be a battery operated buzzer, gong or a light flash which would also be worn by the player. Another variation of the game would be, rather than seats, the players would be standing and only be spatially limited in their movements by electrical connections and the game rules. Here the simulated landscape 13 could still be interposed between the spacially fixed players.

Thus, an improved shooting game has been provided.

What is claimed is:

1. An electronic shooting game for use on a support surface comprising: a pair of seats; means coupled with each seat, respectively, for mounting the same on the support surface for movement relative to the support surface and to the other seat; a gun carried by each seat respectively, each gun having means for directing a beam of electromagnetic radiation toward the other seat; a target carried by each seat respectively, the target of each seat being comprised of electronic photodectector structure, capable of being struck and thereby energized by a radiation beam from the gun of the other seat; means between and spaced from the guns for forming a number of spaced obstacles to the radiation beams emitted by said guns; and circuit means coupled with the photodetector structure of the target of each seat for providing a display representing the actuations of the photodetector structure when struck by radiation beams from the gun of the other seat.

2. An electronic shooting game as set forth in claim 1, wherein each seat includes tilt means capable of being tilted and swiveled relative to the other seat.

3. An electronic shooting game as set forth in claim 1, wherein each gun and the corresponding target are rigidly secured to the respective seat, so that the seat, the gun and the target move as a unit when the seat moves relative to the other seat.

4. An electronic shooting game as set forth in claim 1, wherein said display means is carried by said means for forming said obstacles.

5. An electronic shooting game as set forth in claim 1, wherein each seat has an inclined, generally rigid extension projecting toward the other seat, the gun and target of each seat being coupled adjacent to the upper end of the respective extension.

6. An electronic shooting game as set forth in claim 1, wherein is included means defining a platform for each seat respectively, said mounting means for each seat being coupled to the respective platform, said means forming said obstacles including a frame secured to the platform and extending upwardly therefrom, said display means being on the upper end of said frame.

* * * * *